US012733694B2

(12) United States Patent
Zhang

(10) Patent No.: US 12,733,694 B2
(45) Date of Patent: Sep. 15, 2026

(54) ADHESIVE-REPLACEABLE ADHESIVE BRA ASSEMBLY AND METHOD FOR USING SAME

(71) Applicant: SHENZHEN FANGTA TECHNOLOGY CO., LTD., Shenzhen (CN)

(72) Inventor: Fei Zhang, Shenzhen (CN)

(73) Assignee: SHENZHEN FANGTA TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 19/293,289

(22) Filed: Aug. 7, 2025

(65) Prior Publication Data

US 2025/0359607 A1 Nov. 27, 2025

Related U.S. Application Data

(63) Continuation of application No. PCT/CN2025/073316, filed on Jan. 20, 2025.

(30) Foreign Application Priority Data

Apr. 18, 2024 (CN) ..... 202410467276.4
Jun. 6, 2024 (CN) ..... 202410729983.6

(51) Int. Cl.
*A41C 3/06* (2006.01)

(52) U.S. Cl.
CPC ..... *A41C 3/065* (2013.01)

(58) Field of Classification Search
CPC ..... A41C 3/065
(Continued)

(56) References Cited

U.S. PATENT DOCUMENTS 6,332,624 B1 * 12/2001 Gilsdorf ..... F16F 9/05 280/124.16
7,081,034 B1 * 7/2006 Zoellner ..... A41C 3/04 2/104

(Continued)

FOREIGN PATENT DOCUMENTS

CN 103005729 A 4/2013
CN 213188106 U 5/2021

(Continued)

OTHER PUBLICATIONS

WIPO, International Search Report and Written Opinion for International Application No. PCT/CN2025/073316, May 14, 2025.
Request for the Submission of an Opinion issued in corresponding KR application No. 10-2025-7030515 dated Jun. 26, 2026.

*Primary Examiner* — Gloria M Hale
(74) *Attorney, Agent, or Firm* — HAUPTMAN HAM, LLP

(57) ABSTRACT

An adhesive bra includes a molded cup, a limiting body, and an adhesive. The molded cup has an outer surface and an inner surface. The adhesive body has an adhesive cup-adhesive surface and a protective surface. The cup-adhesive surface is adhered to the inner surface. The limiting body has an adhesive surface, and the limiting body is configured to shape and limit the molded cup or the adhesive body. The outer surface is adhered to the adhesive surface, to shape and limit the molded cup, and the cup-adhesive surface is adhered to the inner surface. Alternatively, the protective surface is adhered to the adhesive surface, to shape and limit the adhesive body, and the inner surface is adhered to the cup-adhesive surface.

15 Claims, 3 Drawing Sheets

(58) Field of Classification Search
USPC ..... 450/81
See application file for complete search history.

(56) References Cited

U.S. PATENT DOCUMENTS

| | | | | |
|---|---|---|---|---|
| 8,113,910 | B2 * | 2/2012 | Fortner | A41D 27/26 450/39 |
| 8,840,442 | B2 * | 9/2014 | Linkon | A41C 3/10 450/36 |
| 10,786,016 | B2 * | 9/2020 | Caden | A61F 13/14 |
| 11,744,297 | B1 * | 9/2023 | Coggiola-Belza | A41C 3/04 450/37 |
| 2006/0166603 | A1 * | 7/2006 | Chen | A41C 3/065 450/81 |
| 2008/0176485 | A1 * | 7/2008 | Linkon | A41C 3/10 450/57 |
| 2009/0286452 | A1 * | 11/2009 | Grayson | A41C 3/04 128/890 |

FOREIGN PATENT DOCUMENTS

| | | | |
|---|---|---|---|
| CN | 216059356 | U | 3/2022 |
| CN | 117016880 | A | 11/2023 |
| CN | 220571576 | U | 3/2024 |
| JP | 3100841 | U | 5/2004 |

* cited by examiner

ADHESIVE-REPLACEABLE ADHESIVE BRA ASSEMBLY AND METHOD FOR USING SAME

CROSS-REFERENCE TO RELATED APPLICATION(S)

This present application a continuation of International Application No. PCT/CN2025/073316, filed Jan. 20, 2025, which claims priority to Chinese Patent Application No. CN202410467276.4 filed Apr. 18, 2024 and Chinese Patent Application No. CN202410729983.6 filed Jun. 6, 2024, the disclosures of both of which are incorporated herein by reference in their entireties.

TECHNICAL FIELD

This disclosure relates to the technical field of underwear, and more particularly, to an adhesive-replaceable adhesive bra assembly and a method for using same.

BACKGROUND

The adhesive bra serves as a fitness product and is attached to the skin during use. An adhesive layer is adhered to an inner surface of the adhesive bra. The adhesive layer is transferred to be molded on the adhesive bra by manual brushing or hot melting. When the adhesive bra is in use, the adhesive layer is adhered to the skin; and when the adhesive bra is not in use, the adhesive layer is covered with a release liner. If the adhesive bra is stored inappropriately after use, for example, if the release liner is inadequately adhered or missing, impurities such as dust will adhere to the adhesive layer, resulting in that the adhesive layer is difficult to clean, and the adhesion is reduced. In addition, the adhesive bra may be used many times, and the adhesive layer may harbor bacteria, which may have adverse effects on human health.

In order to solve the problem, in the related art, a product having a separate structure of an adhesive bra and an adhesive layer appears, i.e. the adhesive bra and the adhesive layer are separate products. During use, the adhesive layer is adhered to the adhesive bra first, and then the adhesive layer is adhered to the skin with the adhesive bra and the adhesive layer serving as a combination. The inventor found that, since the adhesive bra is made from an elastic material and the adhesive layer is made from a colloid material, both of them have a high degree of deformation, and thus it is difficult for a person to smoothly adhere the adhesive layer to the adhesive bra during use, so that the adhesive layer may be wrinkled and is unable to be completely adhered to the skin, resulting in poor adhesion and uncomfortable usage experience after being adhered to the skin, resulting in poor comfort.

SUMMARY

In a first aspect, an adhesive-replaceable adhesive bra assembly is provided in embodiments of the present disclosure. The adhesive-replaceable adhesive bra assembly includes a molded cup, an adhesive body, and a limiting body. The molded cup is made from an elastic material, and the molded cup has an outer surface and an inner surface disposed opposite to each other. The adhesive body has a cup-adhesive surface and a protective surface disposed opposite to each other, and the cup-adhesive surface is configured to be adhered to the inner surface. The limiting body has an adhesive surface, and the limiting body is configured to shape and limit the molded cup or the adhesive body. The outer surface is configured to be adhered to the adhesive surface, to shape and limit the molded cup, and the cup-adhesive surface is configured to be adhered to the inner surface. Alternatively, the protective surface is configured to be adhered to the adhesive surface, to shape and limit the adhesive body, and the inner surface is configured to be adhered to the cup-adhesive surface.

In a second aspect, a method for using the adhesive-replaceable adhesive bra assembly is provided in embodiments of the present disclosure. The method includes: aligning the molded cup to the adhesive surface, and adhering the outer surface onto the adhesive surface; flattening the adhesive body and adhering the cup-adhesive surface to the inner surface; removing the molded cup adhered with the adhesive body from the adhesive surface, adjusting a form of the molded cup, and adhering the adhesive body onto a breast; and removing the molded cup after the adhesive-replaceable adhesive bra has been used, and removing the adhesive body from the molded cup.

In a third aspect, a method for using the adhesive-replaceable adhesive bra assembly is provided in embodiments of the present disclosure. The adhesive body includes the adhesive body and the first release liner, wherein one surface of the adhesive body serves as the cup-adhesive surface, and another surface is the skin attachment surface; one surface of the first release liner is adhered to the skin attachment surface, and another surface of the first release liner is serves as the protective surface. The method includes: aligning the adhesive body with the adhesive surface, and adhering the protective surface onto the adhesive surface; flattening the molded cup and adhering the inner surface to the cup-adhesive surface; removing a combination of the molded cup and the adhesive body from the adhesive surface, tearing off the first release liner from the skin attachment surface, adjusting a form of the molded cup, and adhering the skin attachment surface onto a breast; and removing the molded cup after the adhesive-replaceable adhesive bra has been used, and removing the adhesive body from the molded cup.

BRIEF DESCRIPTION OF THE DRAWINGS

To describe technical solutions in embodiments of the present disclosure more clearly, the following briefly introduces the accompanying drawings required for describing the embodiments or the related art. Apparently, the accompanying drawings in the following description show merely some embodiments of the present disclosure, and a person of ordinary skill in the art may still derive other drawings from these accompanying drawings without creative efforts.

DESCRIPTION OF REFERENCE SIGNS IN THE ACCOMPANYING DRAWINGS

Figure 1:
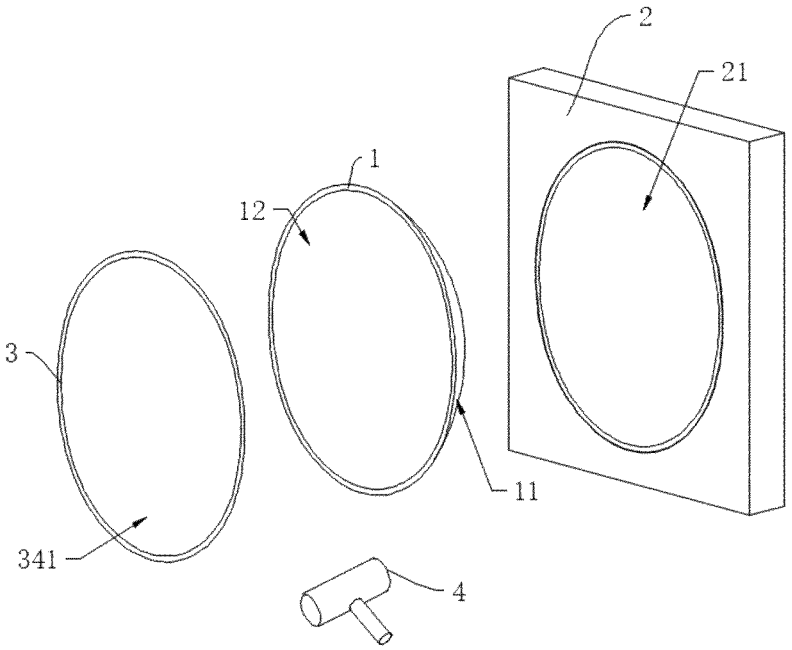
FIG. 1 is a first schematic structural diagram of an adhesive-replaceable adhesive bra assembly provided in an embodiment of the present disclosure.

1, molded cup; 11, outer surface; 12, inner surface; 13, center gore; 14, first breathable hole; 2, limiting body; 21, adhesive surface; 211, limiting post; 3, adhesive body; 31, first adhesive layer; 311, cup-adhesive surface; 32, second adhesive layer; 321, skin attachment surface; 33, intermediate elastic layer; 34, first release liner; 341, protective surface; 35, second breathable hole; 36, second release liner; and 4, pressure roller.

DETAILED DESCRIPTION

In order to make the technical problem to be solved, the technical solution, and the beneficial effects of the present disclosure clearer and more comprehensible, the present disclosure is further described in detail below with reference to the accompanying drawings and embodiments. It may be understood that specific embodiments described herein are merely used to explain the present disclosure, but are not intended to limit the present disclosure.

An objective of the present disclosure is to provide an adhesive-replaceable adhesive bra assembly and a method for using same, which are intended to solve the technical problem existing in the related art that an adhesive layer and an adhesive bra are difficult to adhere smoothly.

The beneficial effects of the adhesive-replaceable adhesive bra assembly provided in the present disclosure lie in the following. Compared with the related art, with the adhesive-replaceable adhesive bra assembly in the present disclosure, the limiting body can shape and limit the molded cup or the adhesive body. Before the adhesive-replaceable adhesive bra is used, the outer surface of the molded cup can be adhered to the adhesive surface, so that the molded cup is unfolded by the limiting body for shaping and limiting, and is unable to move to a wrong position. In this way, the adhesive body can be quickly and smoothly adhered to the inner surface by a person, thereby preventing wrinkles of the adhesive body. Alternatively, the protective surface of the adhesive body can be adhered to the adhesive surface, the adhesive body is fixed and limited by the limiting body and is unable to move to a wrong position, and no wrinkle occurs, so that the molded cup can be adhered to the cup-adhesive surface quickly and smoothly by a person. During use of the adhesive-replaceable adhesive bra, the combination of the molded cup and the adhesive body is removed from the adhesive surface, and the adhesive body is adhered to the breast, so that the adhesive body can be completely attached to the breast due to no wrinkles of the adhesive body, thereby ensuring the adhesive viscosity and comfort in use.

With the adhesive-replaceable adhesive bra assembly, the molded cup and the adhesive body provided in embodiments can be used repeatedly many times, which is environmentally friendly and low in usage cost. In addition, when not in use, the adhesive body and the molded cup are packaged separately to prevent bacterial growth, thereby being more beneficial to human health.

The present disclosure provides a first method for using the adhesive-replaceable adhesive bra assembly. Compared with the related art, before the adhesive-replaceable adhesive bra is used, the outer surface of the molded cup is adhered to the adhesive surface, and the molded cup is fixed and limited, so that the inner surface is in a planar state or in a slightly upward-convex shape. Then, the cup-adhesive surface of the adhesive body can be quickly adhered to the inner surface, thereby simplifying the adhesion operation, saving the time for the adhesion operation, and improving the operation efficiency. In addition, the wrinkles of the adhesive body can also be avoided, the use viscosity is ensured, and the comfort performance is improved. In the meanwhile, the adhesive body is replaceable, thereby being environmentally friendly and beneficial to the human health.

The present disclosure provides a second method for using the adhesive-replaceable adhesive bra assembly. Compared with the related art, before the adhesive-replaceable adhesive bra is used, the protective surface of the adhesive body is adhered to the adhesive surface, so that the adhesive body is shaped and limited, and the cup-adhesive surface is in a planar state, no misalignment and no wrinkles occurs. Then the inner surface of the molded cup can be quickly adhered to the cup-adhesive surface, thereby simplifying the adhesion operation, saving the time for the adhesion operation, improving the operation efficiency, ensuring the use viscosity, and improving the comfort performance. In the meanwhile, the adhesive body is replaceable, which is environmentally friendly and beneficial to human health.

Please refer to FIGS. 1 to 4 together, the adhesive-replaceable adhesive bra assembly provided in the present disclosure will be described. The adhesive-replaceable adhesive bra assembly includes a molded cup 1, an adhesive body 3, and a limiting body 2. The molded cup 1 is made from an elastic material. The molded cup 1 has an outer surface 11 and an inner surface 12 disposed opposite each other. The adhesive body 3 has a cup-adhesive surface 311 and a protective surface 341 disposed opposite to each other. The cup-adhesive surface 311 is configured to be adhered to the inner surface 12. The limiting body 2 has an adhesive surface 21, and the limiting body 2 is configured to shape and limit the molded cup 1 or the adhesive body 3.

The outer surface 11 is configured to be adhered to the adhesive surface 21, to shape and limit the molded cup 1, and the cup-adhesive surface 311 is configured to be adhered to the inner surface 12. Alternatively, the protective surface 341 is configured to be adhered to the adhesive surface 21, to shape and limit the adhesive body 3, and the inner surface 12 is configured to be adhered to the cup-adhesive surface 311.

The molded cup 1 is generally of a circular sheet-like structure, or an approximately circular sheet-like structure. After the molded cup 1 is manufactured and formed, a middle portion of the molded cup 1 protrudes relative to an outer periphery edge portion. When the molded cup 1 is formed or designed, the outer surface 11 may be formed to be a curved surface, and the inner surface 12 may be formed to be a planar surface.

When the molded cup 1 is in use, since the molded cup 1 is made from an elastic material (e.g., solid silica gel, liquid silica gel, or a thermoplastic elastomer) and is flexible and deformable, the molded cup 1 can be deformed such that the inner surface 12 becomes a concave curved surface to adapt to the shape of the human breast.

Figure 4:
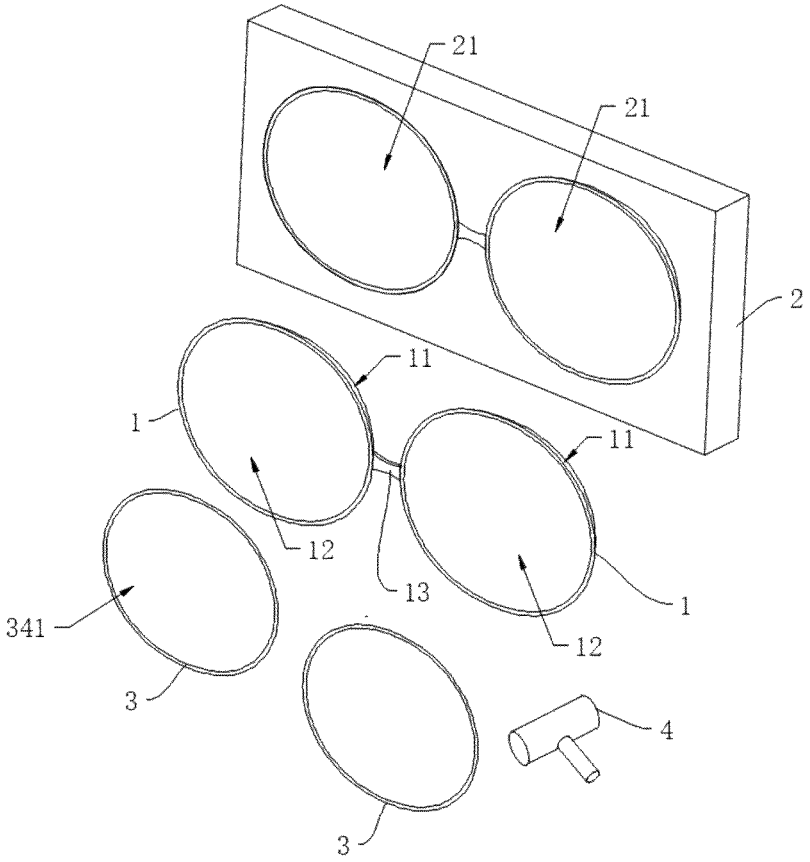
FIG. 4 is a fourth schematic structural diagram of an adhesive-replaceable adhesive bra assembly provided in an embodiment of the present disclosure.

It may be noted that one molded cup 1 may be used independently as illustrated in FIG. 1, or may be used with another one as a combination. If two molded cups 1 are used in combination, the two molded cups 1 are connected via a center gore 13. As illustrated in FIG. 4, the center gore 13 and the two molded cup 1 are integrally formed. Whether one molded cup 1 is used alone or two molded cups 1 are used in combination, each molded cup 1 is shaped by a limiting body 2, and each molded cup 1 is attached to the skin via an adhesive body 3.

The adhesive body 3 is mainly made from an adhesive material, and the cup-adhesive surface 311 of the adhesive body 3 has viscosity. Since the adhesive body 3 needs to be adhered to the skin of the breast, the adhesive body 3 has a certain thickness. In addition, in order to simplify the manufacturing process, the adhesive body 3 generally has a sheet-like structure, and the surface of the sheet-like structure is a planar surface. The adhesive body 3 and the molded cup 1 are of a split structure, in other words, the adhesive body 3 and the molded cup 1 are manufactured independently and packaged independently. When not in use, the adhesive body 3 is placed separately from the molded cup 1, and before use, the adhesive body 3 is adhered to the inner surface 12.

Since the molded cup 1 itself has softness and deformability, and the adhesive body 3 also has deformability, if the adhesive body 3 is directly adhered to the inner surface 12, on the one hand, the inner surface 12 is not easy to fully contact with the adhesive body 3 of a planar structure, and there will be many small gaps therebetween; on the other hand, the molded cup 1 itself is soft, and when the adhesive body 3 is adhered, even if the molded cup 1 is placed on a flat table top, a human have to apply a force to the molded cup 1, so that the molded cup 1 is deformed and displaced, which makes it difficult for the adhesive body 3 to be completely aligned with the molded cup 1, which increase the time for the adhesion operation and the operation complexity. The limiting body 2 is used to shape and limit the molded cup 1 or the adhesive body 3, so as to prevent the molded cup 1 or the adhesive body 3 from deforming.

Specifically, the adhesion operation may be performed by limiting one of the molded cup 1 and the adhesive body 3. For example, the molded cup 1 is aligned with the adhesive surface 21 first, and the outer surface 11 is adhered to the adhesive surface 21, so that the molded cup 1 is fixed and limited and is unable to move, in this case, the inner surface 12 can be maintained as a planar surface or a slightly protruding curved surface. Then the adhesive body 3 of a planar structure is adhered to the inner surface 12. Because the molded cup 1 is made from an elastic material (such as solid silica gel, liquid silica gel, or a thermoplastic elastomer) and has a certain elasticity, it can be ensured that the outer surface 11 is completely attached to the adhesive surface 21.

With respect to the adhesion between a planar surface and a surface which is not fixed and limited, the planar cup-adhesive surface 311 is adhered to the inner surface 12 which is shape-fixed and limited, which can ensure that the cup-adhesive surface 311 is fully adhered to the inner surface 12 without any gap therebetween, and the adhesive body 3 will not be wrinkled. Furthermore, the limiting body 2 limits the position of the molded cup 1, and during the adhesion operation, even if a force is applied to the molded cup 1, the limiting body 2 can limit the deformation of the molded cup 1, so that the adhesive body 3 can be quickly adhered onto the inner surface 12, thereby simplifying the adhesion operation, saving the time for the adhesion operation, and improving the operation efficiency.

For another example, the adhesive body 3 is aligned with the adhesive surface 21 first, and the protective surface 341 is adhered to the adhesive surface 21, so that the adhesive body 3 is fixed and limited and is unable to move. Because the adhesive body 3 is of a sheet-like structure, it can be ensured that the cup-adhesive surface 311 is kept planar, and then the outer surface 11 of the molded cup 1 is adhered to the cup-adhesive surface 311.

It may be noted that, the protective surface 341 is not adhesive, and after the adhesive body 3 is adhered to the limiting body 2, the protective surface 341 can be detached from the adhesive surface 21 by manual operation. The adhesive body 3 further has a skin attachment surface 321 under the protective surface 341, and the skin attachment surface 321 has viscosity, so that after the protective surface 341 is torn off, the skin attachment surface 321 can be attached to the breast.

Since the shape of the molded cup 1 is slightly larger than the shape of the adhesive body 3, in order to facilitate operation of the user, the molded cup 1 is preferably fixed on the limiting body 2 first, and then the adhesive body 3 is adhered to the inner surface 12.

It may be noted that the limiting body 2, the molded cup 1, and the adhesive body 3 are of a spilt structure, in other words, the limiting body 2, the molded cup 1, and the adhesive body 3 are manufactured independently and packaged independently. When not in use, the limiting body 2, the molded cup 1, and the adhesive body 3 are independently placed, and when in use, the molded cup 1 or the adhesive body 3 is adhered to the adhesive surface 21. In addition, the limiting body 2, the adhesive body 3, and the molded cup 1 are sold as a whole.

The limiting body 2 may be made from a hard material, and needs to have a certain hardness. During the adhesion operation, the limiting body 2 supports the molded cup 1 or the adhesive body 3, so as to prevent the molded cup 1 or the adhesive body 3 from being deformed. The limiting body 2 is coated with an adhesive layer, and the coated adhesive layer is very thin to form the adhesive surface 21. The adhesive layer is adhesive and has hardness. Since the adhesive layer is coated on the limiting body 2 and does not deform at will, so that the elastic material molded cup 1 can be adhered, and the protective surface 341 which is not adhesive can be adhered. Under the action of an external force of tearing by a person, the molded cup 1 made from the elastic material can also be separated from the adhesive layer, and the protective surface 341 can also be separated from the adhesive layer.

The limiting body 2 can also directly adopt a fixing colloid (such as a double-sided adhesive tape with a thickness) in a fixed state, and one surface of the colloid which is adhesive serves as the adhesive surface 21. The colloid can also be adhered to a flat table top, and the molded cup 1 or the adhesive body 3 is fixed by means of adhesive. The colloid in a fixed state may be not deformed at will, so that the elastic material molded cup 1 can be adhered, and the protective surface 341 which is not adhesive can be adhered. Under the action of an external force of tearing by a person, the molded cup 1 made from the elastic material can also be separated from the colloid, and the protective surface 341 can also be separated from the colloid.

Compared with the related art, with the adhesive-replaceable adhesive bra assembly in the present disclosure, the limiting body 2 can shape and limit the molded cup 1 or the adhesive body 3. Before the adhesive-replaceable adhesive bra is used, the outer surface 11 of the molded cup 1 can be adhered to the adhesive surface 21, so that the molded cup 1 is fixed and limited by the limiting body 2, and is unable to move to a wrong position. In this way, the adhesive body 3 can be quickly and smoothly adhered to the inner surface 12 by a person, thereby preventing wrinkles of the adhesive body 3. Alternatively, the protective surface 341 of the adhesive body 3 can be adhered to the adhesive surface 21, the adhesive body 3 is fixed and limited by the limiting body 2 and is unable to move to a wrong position, and no wrinkle occurs, so that the molded cup 1 can be adhered to the cup-adhesive surface 311 quickly and smoothly by a person. During use of the adhesive-replaceable adhesive bra, the combination of the molded cup 1 and the adhesive body 3 is removed from the adhesive surface 21, and the adhesive body 3 is adhered to the breast, so that the adhesive body 3 can be completely attached to the breast due to no wrinkles of the adhesive body 3, thereby ensuring the adhesive viscosity and comfort in use.

With the adhesive-replaceable adhesive bra assembly provided in embodiments, the molded cup 1 and the adhesive body 3 can be used repeatedly many times, which is environmentally friendly and low in usage cost. When not in use, the adhesive body 3, the molded cup 1, and the limiting body 2 are respectively packaged to prevent bacterial growth, thereby being more beneficial to human health.

Figure 5:
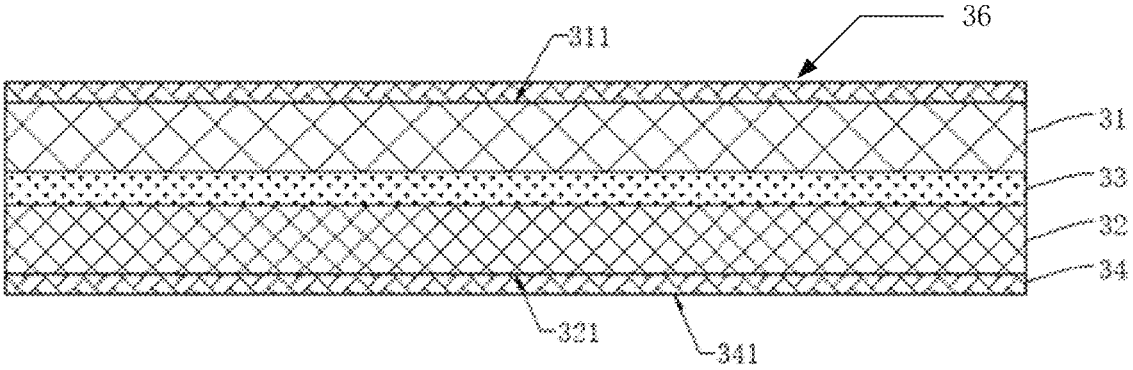
FIG. 5 is a schematic cross-sectional diagram of an adhesive body of an adhesive-replaceable adhesive bra provided in an embodiment of the present disclosure.

In some embodiments, the adhesive body 3 can have a structure as illustrated in FIG. 5. Reference can be made to FIG. 5, the adhesive body 3 includes an adhesive main body and a first release liner 34. One surface of the adhesive main body serves as the cup-adhesive surface 311, and the other surface of the adhesive main body serves as the skin attachment surface 321, One surface of the first release liner 34 is adhered to the skin attachment surface 321, and the other surface of the first release liner 34 serves as the protective surface 341.

The cup-adhesive surface 311 and the skin attachment surface 321 are both adhesive, the cup-adhesive surface 311 is used to adhere to the inner surface 12, and the skin attachment surface 321 is used to adhere to the breast. The first release liner 34 itself is not adhesive, but the first release liner 34 itself has hardness and can be maintained in a planar state. The first release liner 34 covers the skin attachment surface 321, so as to protect the skin attachment surface 321, thereby preventing the skin attachment surface 321 from sticking impurities before being adhered to skin, thus ensuring adhesive performance and wear comfort.

Before the adhesive body 3 is adhered, the first release liner 34 is attached to the skin attachment surface 321, and the hardness of the first release liner 34 enables the adhesive body 3 to be maintained in a planar state as a whole, thereby further ensuring that the adhesive body 3 can be adhered to the molded cup 1 seamlessly. After the combination of the adhesive body 3 and the molded cup 1 is removed from the limiting body 2, the first release liner 34 is torn off so that the skin attachment surface 321 is exposed.

Since the adhesive body 3 and the molded cup 1 are manufactured independently and packaged independently, when not in use, the adhesive body 3 and the molded cup 1 are placed independently, and in order to ensure the viscosity of the cup-adhesive surface 311, a second release liner 36 can be adhered to the cup-adhesive surface 311.

In some embodiments, the adhesive main body may have a structure as illustrated in FIG. 5. As illustrated in FIG. 5, the adhesive main body includes a first adhesive layer 31, an intermediate elastic layer 33, and a second adhesive layer 32 which are sequentially adhered. An outer surface of the first adhesive layer 31 serves as the cup-adhesive surface 311, and an outer surface of the second adhesive layer 32 serves as the skin attachment surface 321.

The first adhesive layer 31 is configured to adhere to the inner surface 12, and the second adhesive layer 32 is configured to adhere to the skin. Preferably, the first adhesive layer 31 is a pressure-sensitive adhesive layer, and the pressure-sensitive adhesive layer is suitable for adhering to the molded cup 1 due to good adhesive performance and peeling strength, and the pressure-sensitive adhesive layer is unlikely to fall off and be displaced after adhesion. The second adhesive layer 32 is a silicone gel layer, and the silicone gel layer is made from silicone gel with a relative low peeling strength, so that no pain will be caused to a user when the adhesive layer is peeled off. The silicone gel layer may define multiple small holes, so as to improve the moisture permeability and air permeability, and make the attachment more comfortable.

The intermediate elastic layer 33 is used as a base material on which the first adhesive layer 31 and the second adhesive layer 32 are coated, so that the adhesive body 3 is easier to be molded. The intermediate elastic layer 33 serves as a base material, and can also provide support for the first adhesive layer 31 and the second adhesive layer 32, so that the adhesive body 3 can be torn off from the molded cup 1 as a whole, so as to ensure that the molded cup 1 and the adhesive body 3 can be reused.

It may be noted that the intermediate elastic layer 33 needs to have waterproof performance and air permeability performance, and may not harm human skin.

Preferably, the intermediate elastic layer 33 is made from a cloth, or made from a film material such as a silicon rubber film and a polyurethane film (PU film). The intermediate elastic layer 33 itself has elasticity, and the formed layered structure has contractility and extensibility, so that the whole adhesive body 3 has contractility and extensibility.

Specifically, before the adhesive body 3 and the molded cup 1 are adhered, the adhesive body 3 is flattened first. Since the intermediate elastic layer 33 has expansibility, when the adhesive body 3 is flattened artificially, the intermediate elastic layer 33 expands, so that the first adhesive layer 31 also expands. In this way, the cup-adhesive surface 311 can be completely attached to the inner surface 12. After the adhesive body 3 is adhered, the combination of the molded cup 1 and the adhesive body 3 is removed from the adhesive surface 21, the molded cup 1 is no longer limited, and the molded cup 1 is restored to a structure for use. In this case, the molded cup 1 also deforms the adhesive body 3, due to the contractility and extensibility of the intermediate elastic layer 33, after the intermediate elastic layer 33 is changed from a planar surface into a curved surface, part of the intermediate elastic layer 33 coated with the first adhesive layer 31 is expanded, and part of the intermediate elastic layer 33 coated with the second adhesive layer 32 is contracted, so that the first adhesive layer 31 is expanded, and the second adhesive layer 32 is contracted. As such, the adhesive body 3 can adapt a concave curved surface of the inner surface 12 when the molded cup 1 is in use, and the skin attachment surface 321 has no wrinkle.

In some embodiments, after the cup-adhesive surface 311 is adhered to the inner surface 12, an outer peripheral edge of the adhesive body 3 does not exceed an outer peripheral edge of the molded cup 1.

In one embodiment, the outer peripheral edge of the adhesive body 3 coincides with the outer peripheral edge of the molded cup 1, so as to ensure that the back surface of the molded cup 1 can be completely attached to the breast, and ensure the contact area between the molded cup 1 and the breast, thereby enhancing the adhesive strength between the molded cup 1 and the breast. At the same time, the protective effect of the molded cup 1 to the breast is ensured, thus preventing exposure.

In another embodiment, the outer peripheral edge of the molded cup 1 exceeds the outer peripheral edge of the adhesive body 3, in other words, the adhesive body 3 does not completely cover the molded cup 1. In this way, while the positioning between the breast and the molded cup 1 is ensured, the adhesive range between the molded cup 1 and the breast is reduced, thus avoiding the uncomfortable feeling of the wearer, and optimizing the wearing experience. In this case, as long as the breast of the wearer adapts to the size of the molded cup 1, exposure can also be avoided.

Figure 2:
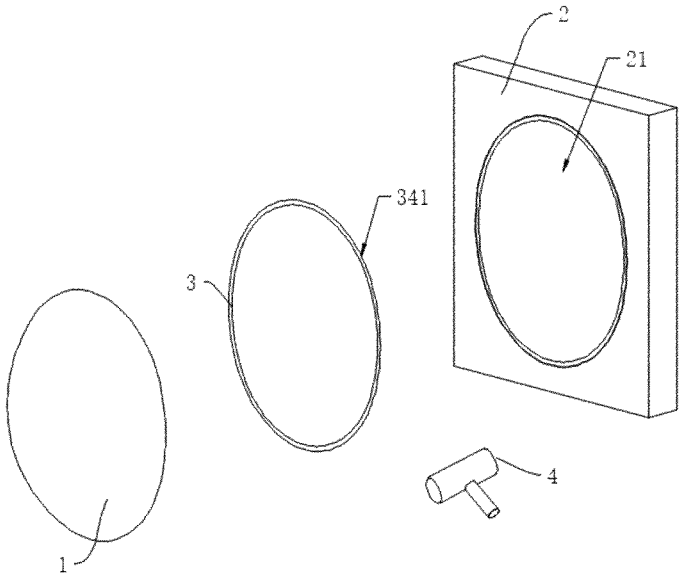
FIG. 2 is a second schematic structural diagram of an adhesive-replaceable adhesive bra assembly provided in an embodiment of the present disclosure.
Figure 6:
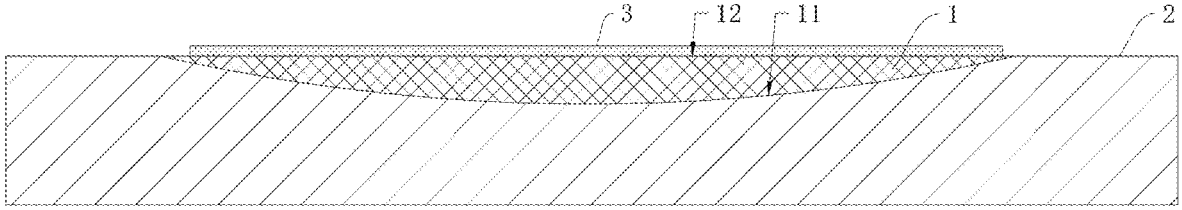
FIG. 6 is a schematic structural diagram illustrating a molded cup of an adhesive-replaceable adhesive bra being limited in a limiting body provided in an embodiment of the present disclosure.

In some embodiments, the limiting body 2 can have the structure as illustrated in FIGS. 1, 2, and 6. With reference to FIGS. 1, 2 and 6, the limiting body 2 is an attachment device, the attachment device defines a cavity, and the cavity structure of the cavity is adapted to a shape and a thickness of the molded cup 1. A cavity wall of the cavity serves as the adhesive surface 21.

The attachment device can be made from a hard material and has a certain hardness. The attachment device can be regarded as a flat plate, one surface of the flat plate defines a downwardly recessed cavity, and the cavity is used for shaping and limiting the molded cup 1 or the adhesive body 3, especially for shaping and limiting the molded cup 1. Since the cavity structure of the cavity is adapted to the shape and structure of the molded cup 1, after the molded cup 1 is placed into the cavity, the cavity limits the state of the molded cup 1, so that the inner surface 12 is maintained as a planar surface, so as to facilitate the adhesion between the adhesive body 3 of the planar structure and the inner surface 12.

Specifically, the molded cup 1 is of a non-uniform thickness structure. Preferably, in order to adapt to the shape of the breast, the thickness of the molded cup 1 gradually decreases from a central point to an outer peripheral edge. In other words, the thickness of the molded cup 1 at the central point is the largest, and the thickness of the molded cup 1 at the outer peripheral edge is the smallest.

After the molded cup 1 is manufactured and molded, a middle portion of the molded cup 1 protrudes relative to the outer peripheral edge portion of the molded cup 1. When the molded cup 1 is molded or designed, the outer surface 11 may be formed to be a curved surface, the inner surface 12 may be formed to be a planar surface. Since the molded cup 1 is made from an elastic material (such as solid silica gel, liquid silica gel or a thermoplastic elastomer), the molded cup 1 has softness and deformability, and can be deformed during use, so that the inner surface 12 can be changed into a concave curved surface, to adapt the shape of the breast.

By designing the molded cup 1 with unequal thickness, the deformation degree of the outer surface 11 can be reduced. In addition, since the cavity structure of the cavity is adapted to the shape and the thickness of the molded cup 1, the inner surface 12 can be planar and the outer surface 11 can be still curved after the molded cup 1 is limited in the cavity, as illustrated in FIG. 6, so as to facilitate the adhesion operation of the adhesive body 3 in the next step.

In addition, since the cavity structure of the cavity is adapted to the shape and thickness of the molded cup 1, in other words, the depth of each point of the cavity is not equal. The cavity wall of the cavity, i.e. the adhesive surface 21, is an arc surface, since the arc surface has a large amount of limiting directions relative to a planar surface, when the adhesion body 3 is adhered, the molded cup 1 can be limited in multiple directions.

The limiting body 2, with only a cavity, has a simple structure, is easy to be manufactured, and has a low manufacturing cost. Compared with the method of forming the adhesive body 3 on the molded cup 1 by manual adhesive brushing or hot melting, the adhesive-replaceable adhesive bra provided in embodiments can be repeatedly used many times, which result in a lower usage cost. When the adhesive-replaceable adhesive bra is not in use, the adhesive body 3 is packaged separately, which not produce bacteria and is more beneficial to human health.

In addition to limiting the molded cup 1, the cavity can also be used to limit the adhesive body 3. Since the adhesive body 3 is of a planar structure of equal thickness, a curved structure of equal thickness will be formed after the adhesive body 3 is adhered in the cavity, and the curved cup-adhesive surface 311 is adapted to the curved adhesion surface 21, i.e. can be adapted to the curved outer surface 11, thereby facilitating the adhesion of the molded cup 1 to the adhesive body 3.

In another embodiment, the limiting body 2 is an attachment device, the attachment device does not define any cavity, the attachment device is a planar plate, and an adhesive layer is directly coated on a surface of the attachment device to form the adhesive surface 21. The adhesive surface 21 is flush with an outer surface of the attachment device, in other words, the outer surface of the attachment device may form the adhesive surface 21.

Figure 3:
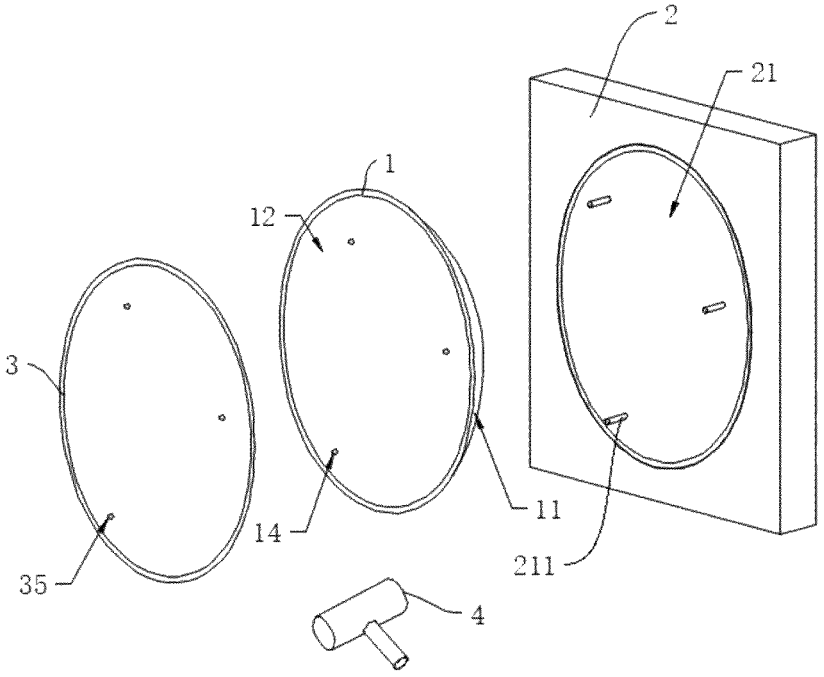
FIG. 3 is a third schematic structural diagram of an adhesive-replaceable adhesive bra assembly provided in an embodiment of the present disclosure.

In some embodiments, the molded cup 1, adhesive body 3, and limiting body 2 may also have the structure as illustrated in FIG. 3. As illustrated FIG. 3, the molded cup 1 defines a first breathable hole 14, and the adhesive body 3 defines a second breathable hole 35. A limiting post 211 is disposed on the adhesive surface 21. The limiting post 211 is configured to be inserted into the first breathable hole 14 and the second breathable hole 35 for limiting.

It may be noted that, the molded cup 1 defines multiple first breathable holes 14, the adhesive body 3 defines multiple second breathable holes 35, and at a design and manufacturing stage of the molded cup 1 and the adhesive body 3, positions of the multiple first breathable holes 14 correspond to positions of the multiple second breathable holes 35 in one-to-one correspondence. The first breathable holes 14 and the second breathable holes 35 are all used for air permeability to ensure the air permeability performance of the adhesive bra.

Since the molded cup 1 and the adhesive body 3 are manufactured separately and packaged separately, in order to ensure that the multiple first breathable holes 14 and the multiple second breathable holes 35 are in one-to-one correspondence after the molded cup 1 and the adhesive body 3 are adhered, limiting posts 211 are further provided on the adhesive surface 21. When the outer surface 11 of the molded cup 1 is adhered to the adhesive surface 21, the limiting posts 211 pass through the first breathable holes 14, and when the cup-adhesive surface 311 of the adhesive body 3 is adhered to the inner surface 12, the limiting posts 211 further pass through the second breathable holes 35. Likewise, if the adhesive body 3 is first attached, the limiting posts 211 pass through the second breathable holes 35, and then the limiting posts 211 pass through the first breathable holes 14. By providing the limiting posts 211, the first breathable hole 14*s* can be ensured to correspond to the second breathable holes 35 axially.

It may be noted that, the number of the first breathable holes 14 is greater than the number of the limiting posts 211, and preferably, the number of the limiting posts 211 is three. Although only three first breathable holes 14 and three second breathable holes 35 are illustrated in FIG. 3, the number is not limited to only three.

In some embodiments, the adhesive-replaceable adhesive bra assembly may also have a structure as illustrated in FIG.

1. Referring to FIG. 1, the adhesive-replaceable adhesive bra assembly further includes a pressure roller 4. The pressure roller 4 is configured to roll the adhesive body 3 after the cup-adhesive surface 311 is adhered to the inner surface 12; or, the pressure roller 4 is configured to roll the molded cup 1 after the inner surface 12 is adhered to the cup-adhesive surface 311.

After the adhesive body 3 is adhered to the molded cup 1 manually, the pressure roller 4 can be used to roll on the protective surface 341 or the outer surface 11, so as to squeeze out small bubbles between the adhesive body 3 and the molded cup 1, thereby further improving the adhesion degree between the adhesive body 3 and the molded cup 1.

The pressure roller 4 can be packaged together with the limiting body 2, and can also be packaged separately. The pressure roller 4 may be sold together with the limiting body 2, the adhesive body 3, and the molded cup 1.

Based on the same inventive concept, embodiments of the present disclosure further provide a method for using the adhesive-replaceable adhesive bra assembly. The method includes the following operations.

At S1, the molded cup 1 is aligned to the adhesive surface 21, and the outer surface 11 is adhered onto the adhesive surface 21.

At S2, the adhesive body 3 is flattened and the cup-adhesive surface 311 is adhered to the inner surface 12.

At S3, the molded cup 1 adhered with the adhesive body 3 is removed from the adhesive surface 21, a form of the molded cup 1 is adjusted, and the adhesive body 3 is adhered onto a breast.

At S4, the molded cup 1 is removed after the adhesive-replaceable adhesive bra has been used, and the adhesive body 3 is removed from the molded cup 1.

It may be noted that the limiting body 2, the molded cup 1, and the adhesive body 3 are of a spilt structure, in other words, the limiting body 2, the molded cup 1, and the adhesive body 3 are manufactured independently and packaged independently. When not in use, the limiting body 2, the molded cup 1, and the adhesive body 3 are independently placed, and when in use, the molded cup 1 is attached to the adhesive surface 21. In addition, the limiting body 2, the adhesive body 3, and the molded cup 1 are sold as a whole. One molded cup 1 can be attached with multiple adhesive bodies 3. When the viscosity of an adhesive body 3 is reduced, a new adhesive body 3 can be replaced.

Since the molded cup 1 itself has softness and deformability, if the adhesive body 3 is directly adhered to the inner surface 12, on the one hand, the inner surface 12 is not easy to fully contact with the adhesive body 3 of a planar structure, and there will be many small gaps therebetween; on the other hand, the molded cup 1 is soft, and when the adhesive body 3 is adhered, a force has to be applied to the molded cup 1, so that the molded cup 1 is deformed, which makes it difficult for the adhesive body 3 to be completely aligned with the molded cup 1, which increase the time for the adhesion operation and the operation complexity. The limiting body 2 is used to shape and limit the molded cup 1 so as to prevent the molded cup 1 from deforming.

Specifically, at S1, the molded cup 1 is aligned to the adhesive surface 21 and the outer surface 11 is adhered to the adhesive surface 21, so that the inner surface 12 can be maintained as a planar surface or a curved surface slightly protruding from the adhesive surface 21.

At S2, compared with the adhesion between a planar surface and a surface which is not shaped and limited, the planar cup-adhesive surface 311 is adhered to the inner surface 12 which is shaped and limited, which can ensure that the cup-adhesive surface 311 is fully adhered to the inner surface 12 without any gap therebetween, and the adhesive body 3 will not be wrinkled. Furthermore, at S2, even if a force is applied to the molded cup 1, the limiting body 2 can limit the deformation of the molded cup 1, so that the adhesive body 3 can be quickly adhered to the inner surface 12.

Further, at S2, after the adhesive body 3 is adhered to the inner surface 12, small air bubbles between the adhesive body 3 and the molded cup 1 may be squeezed out by pressing the adhesive body 3 or rolling the adhesive body 3 with the pressure roller 4.

Compared with the related art, with the method for using the adhesive-replaceable adhesive bra assembly provided in the present disclosure, the outer surface 11 of the molded cup 1 is adhered to the adhesive surface 21 before use, and the molded cup 1 is shaped and limited, so that the inner surface 12 is in a planar state or a shaped curved surface slightly protruding from the adhesive surface 21. Then, the cup-adhesive surface 311 of the adhesive body 3 can be quickly adhered to the inner surface 12, thereby simplifying the adhesion operation, saving the time for the adhesion operation, and improving the operation efficiency. In addition, the wrinkles of the adhesive body 3 can also be avoided, the use viscosity is ensured, and the comfort performance is improved. In the meanwhile, the adhesive body 3 is replaceable, thereby being environmentally friendly and beneficial to the human health.

It may be noted that, the limiting body 2 with only the adhesive surface 21 has a simple structure, is easy to be manufactured, and has a low manufacturing cost. Compared with the method of forming the adhesive body 3 on the molded cup 1 by manual adhesive brushing or hot melting, with the method for using the adhesive-replaceable adhesive bra assembly provided in embodiments, the molded cup 1 and the adhesive body 3 can be repeatedly used many times, which result in a lower usage cost. When the adhesive-replaceable adhesive bra is not in use, the adhesive body 3 is packaged separately, which not produce bacteria and is more beneficial to human health.

In some embodiments, the adhesive body 3 includes an adhesive main body and a first release liner 34. One surface of the adhesive main body serves as the cup-adhesive surface 311, and the other surface of the adhesive main body serves as the skin attachment surface 321, One surface of the first release liner 34 is adhered to the skin attachment surface 321, and the other surface of the first release liner 34 serves as the protective surface 341. The first release layer 34 is of a planar structure.

Specifically, operations at S3 includes the following. The molded cup 1 adhered with the adhesive body 3 is removed from the adhesive surface 21, the first release liner 34 is peeled off from the skin attachment surface 321, the form of the molded cup 1 is adjusted, and the skin attachment surface 321 is adhered onto the breast.

The first release liner 34 itself has a hardness, and can remain in a planar state. Before operations at S1, the first release liner 34 is adhered to the skin attachment surface 321, and the hardness of the first release liner 34 itself enables the adhesive body 3 to remain in a planar state as a whole. At S2, the adhesive body 3 can be further ensured to be adhered to the molded cup 1 on the adhesive surface 21 seamlessly. After the adhesive body 3 has been adhered, the first release liner 34 is torn off.

In some embodiments, before operations at S1 and/or after operations at S4, the method further includes the following. The molded cup 1 is cleaned, so that the molded cup 1 is kept clean and can be conveniently used again, and residual colloid adhered to the inner surface 12 is removed.

If the molded cup 1 is cleaned before operations at S1, the washed molded cup 1 needs to be dried before proceeding to operations at S1.

Based on the same inventive concept, embodiments also provide another method for using the adhesive-replaceable adhesive bra assembly. The adhesive body 3 includes an adhesive main body and a first release liner 34. One surface of the adhesive main body serves as the cup-adhesive surface 311, and the other surface of the adhesive main body serves as the skin attachment surface 321, One surface of the first release liner 34 is adhered to the skin attachment surface 321, and the other surface of the first release liner 34 serves as the protective surface 341. The method for using the adhesive-replaceable adhesive bra assembly includes the following.

At S1, the adhesive body 3 is aligned with the adhesive surface 21, and the protective surface 341 is adhered onto the adhesive surface 21.

At S2, the molded cup 1 is flattened and the inner surface 12 is adhered to the cup-adhesive surface 311.

At S3, a combination of the molded cup 1 and the adhesive body 3 is removed from the adhesive surface 21, the first release liner 34 is torn off from the skin attachment surface 321, a form of the molded cup 1 is adjusted, and the skin attachment surface 321 is adhered onto a breast.

At S4, the molded cup 1 is removed after the adhesive-replaceable adhesive bra has been used, and the adhesive body 3 is removed from the molded cup 1.

The adhesive body 3 is mainly made from an adhesive material, and the cup-adhesive surface 311 of the adhesive body 3 has viscosity. Since the adhesive body 3 needs to be adhered to the skin of the breast, the adhesive body 3 has a certain thickness. In addition, in order to simplify the manufacturing process, the adhesive body 3 generally has a sheet-like structure, and the surface of the sheet-like structure is a planar surface.

It may be noted that, the protective surface 341 is not adhesive, and after the adhesive body 3 is adhered to the limiting body 2, the protective surface 341 may be detached from the adhesive surface 21 by manual operation. The adhesive body 3 further has a skin attachment surface 321 under the protective surface 341, and the skin attachment surface 321 has viscosity, so that after the protective surface 341 is torn off, the skin attachment surface 321 can be attached to the breast.

Compared with the related art, with the method for using the adhesive-replaceable adhesive bra assembly provided in the present disclosure, before the adhesive-replaceable adhesive bra is used, the protective surface 341 of the adhesive body 3 is adhered to the adhesive surface 21, so that the adhesive body 3 is fixedly and limited, the cup-adhesive surface 311 can present a planar state, and no misalignment or wrinkle occurs. Then the inner surface 12 of the molded cup 1 can be quickly adhered to the cup-adhesive surface 311, thereby simplifying the adhesion operation, saving the time for the adhesion operation, and improving the operation efficiency, ensuring he use viscosity, and improving the comfort performance. In the meanwhile, the adhesive body 3 is replaceable, which is environmentally friendly and beneficial to human health.

In some embodiments, before operations at S1 and/or after operations at S4, the method further includes the following. The molded cup 1 is cleaned, so that the molded cup 1 is kept clean and can be conveniently used again, and residual colloid adhered to the inner surface 12 is removed.

If the molded cup 1 is cleaned before operations at S1, the washed molded cup 1 needs to be dried before proceeding to operations at S1.

The foregoing descriptions are merely preferred embodiments of the present disclosure, but are not intended to limit the present disclosure. Any modification, equivalent replacement, and improvement made within the spirit and principle of the present disclosure shall fall within the scope of protection of the present disclosure.

What is claimed is:

1. An adhesive-replaceable adhesive bra assembly, wherein the adhesive-replaceable adhesive bra assembly comprises an adhesive-replaceable adhesive bra adherable to a wearer and a limiting body configured to shape and limit the adhesive-replaceable adhesive bra prior to wear on the wearer, the adhesive-replaceable adhesive bra comprises a molded cup and an adhesive body:

wherein the molded cup is made from an elastic material, the molded cup having an outer surface and an inner surface disposed opposite to each other;

wherein the adhesive body has a cup-adhesive surface and a protective surface disposed opposite to each other, and the cup-adhesive surface is configured to be adhered to the inner surface; and wherein the limiting body has an adhesive surface, and the limiting body is configured to shape and limit the molded cup or the adhesive body;

wherein the outer surface is configured to be adhered to the adhesive surface, to shape and limit the molded cup, and the cup-adhesive surface is configured to be adhered to the inner surface; or the protective surface is configured to be adhered to the adhesive surface, to shape and limit the adhesive body, and the inner surface is configured to be adhered to the cup-adhesive surface.

2. The adhesive-replaceable adhesive bra assembly of claim 1, wherein the adhesive body comprises:

an adhesive main body, wherein one surface of the adhesive main body serves as the cup-adhesive surface, and another surface of the adhesive main body is a skin attachment surface; and a first release liner, one surface of the first release liner is adhered to the skin attachment surface, and another surface of the first release liner serves as the protective surface.

3. The adhesive-replaceable adhesive bra assembly of claim 2, wherein the adhesive main body comprises a first adhesive layer, an intermediate elastic layer, and a second adhesive layer which are sequentially adhered to each other; and an outer surface of the first adhesive layer serves as the cup-adhesive surface, and an outer surface of the second adhesive layer serves as the skin attachment surface.

4. The adhesive-replaceable adhesive bra assembly of claim 1, wherein the adhesive body further comprises:

a second release liner adhered to the cup-adhesive surface.

5. The adhesive-replaceable adhesive bra assembly of claim 1, wherein the limiting body defines a cavity, a cavity structure of the cavity is adapted to a shape and a thickness of the molded cup, and a cavity wall of the cavity serves as the adhesive surface.

6. The adhesive-replaceable adhesive bra assembly of claim 1, wherein the limiting body is a planar plate, and an outer surface of the planar plate forms the adhesive surface.

7. The adhesive-replaceable adhesive bra assembly of claim 1, wherein the molded cup defines a first breathable hole, the adhesive body defines a second breathable hole; and a limiting post is disposed on the adhesive surface, and the limiting post is configured to be inserted into the first breathable hole and the second breathable hole for limiting.

8. The adhesive-replaceable adhesive bra assembly of claim 7, wherein the first breathable hole is implemented as a plurality of first breathable holes, the second breathable hole is implemented as a plurality of second breathable holes, the limiting post is implemented as a plurality of limiting posts, the plurality of first breathable holes and the plurality of second breathable holes are in one-to-one correspondence, and the number of the plurality of first breathable holes is greater than the number of the plurality of limiting posts.

9. The adhesive-replaceable adhesive bra assembly of claim 1, wherein the limiting body is made of a fixing colloid.

10. The adhesive-replaceable adhesive bra assembly of claim 1, further comprising a pressure roller; and the pressure roller is configured to roll the adhesive body after the cup-adhesive surface is adhered to the inner surface; or the pressure roller is configured to roll the molded cup after the inner surface is adhered to the cup-adhesive surface.

11. The adhesive-replaceable adhesive bra assembly of claim 1, wherein after the outer surface is adhered onto the adhesive surface, the inner surface is in a planar state or in a slightly upward-convex shape.

12. A method for using the adhesive-replaceable adhesive bra assembly of claim 1, comprising:

aligning the molded cup to the adhesive surface, and adhering the outer surface onto the adhesive surface;

flattening the adhesive body and adhering the cup-adhesive surface to the inner surface;

removing the molded cup adhered with the adhesive body from the adhesive surface, adjusting a form of the molded cup, and adhering the adhesive body onto a breast; and removing the molded cup after the adhesive-replaceable adhesive bra has been used, and removing the adhesive body from the molded cup.

13. The method of claim 12, wherein after the outer surface is adhered onto the adhesive surface, the inner surface is in a planar state or in a slightly upward-convex shape.

14. A method for using the adhesive-replaceable adhesive bra assembly of claim 1, wherein the adhesive body comprises an adhesive main body and a first release liner, wherein one surface of the adhesive main body serves as the cup-adhesive surface, and another surface of the adhesive main body is a skin attachment surface; one surface of the first release liner is adhered to the skin attachment surface, and another surface of the first release liner serves as the protective surface;

wherein the method comprises:

aligning the adhesive body with the adhesive surface, and adhering the protective surface onto the adhesive surface;

flattening the molded cup and adhering the inner surface to the cup-adhesive surface;

removing a combination of the molded cup and the adhesive body from the adhesive surface, tearing off the first release liner from the skin attachment surface, adjusting a form of the molded cup, and adhering the skin attachment surface onto a breast; and removing the molded cup after the adhesive-replaceable adhesive bra has been used, and removing the adhesive body from the molded cup.

15. The method of claim 13, wherein after the outer surface is adhered onto the adhesive surface, the inner surface is in a planar state or in a slightly upward-convex shape.

* * * * *